US009222289B2

(12) United States Patent
Nagaoka et al.

(10) Patent No.: US 9,222,289 B2
(45) Date of Patent: Dec. 29, 2015

(54) ACTUATOR UNIT AND DOOR LATCH DEVICE PROVIDED WITH ACTUATOR UNIT

(71) Applicant: Mitsui Kinzoku Act Corporation, Kanagawa (JP)

(72) Inventors: Tomoharu Nagaoka, Yokohama (JP); Takao Taga, Yokohama (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 0 days.

(21) Appl. No.: 14/390,659

(22) PCT Filed: Nov. 27, 2012

(86) PCT No.: PCT/JP2012/080611
§ 371 (c)(1),
(2) Date: Oct. 3, 2014

(87) PCT Pub. No.: WO2013/150681
PCT Pub. Date: Oct. 10, 2013

(65) Prior Publication Data

US 2015/0091309 A1 Apr. 2, 2015

(30) Foreign Application Priority Data

Apr. 5, 2012 (JP) ..... 2012-086627

(51) Int. Cl.
*E05C 3/06* (2006.01)
*E05B 81/14* (2014.01)
(Continued)

(52) U.S. Cl.
CPC ..... *E05B 81/14* (2013.01); *E05B 81/06* (2013.01); *E05B 81/16* (2013.01); *E05B 81/30* (2013.01); *E05B 81/42* (2013.01); *Y10T 292/108* (2015.04)

(58) Field of Classification Search
CPC ..... E05B 81/04; E05B 81/06; E05B 81/12; E05B 81/14; E05B 81/16; E05B 81/25; E05B 81/26; E05B 81/30; E05B 81/42
USPC ..... 292/201, 216, DIG. 23, 279, 280
See application file for complete search history.

(56) References Cited

U.S. PATENT DOCUMENTS

2007/0277632 A1 12/2007 Yoshikuwa
2010/0194121 A1 8/2010 Konomoto et al.
(Continued)

FOREIGN PATENT DOCUMENTS

CN 201087626 Y 7/2008
EP 2 196 606 A1 6/2010
(Continued)

OTHER PUBLICATIONS

International Search Report dated Jan. 22, 2013 issued in PCT/JP2012/080611.
(Continued)

*Primary Examiner* — Alyson M Merlino
(74) *Attorney, Agent, or Firm* — Foley & Lardner LLP

(57) ABSTRACT

When a worm wheel is in a first stop position a locking surface of a first projecting portion and a locking surface of a second projecting portion, which is provided back to a pressing surface of a first projecting portion adjacent to the locking surface of the first projecting portion, are situated along concentric arc-shaped rotational loci of the rotational end faces of a first engagement arm and a second engagement arm, while when the worm wheel is in a second stop position a locking surface of the second projecting portion and the locking surface of the first projecting portion, which is provided back to a pressing surface of the second projecting portion adjacent to the locking surface, are situated along the concentric arc-shaped rotational loci of the rotational end faces of the first engagement arm and the second engagement arm.

5 Claims, 7 Drawing Sheets

(51) Int. Cl.

| | |
|---|---|
| ***E05B 81/06*** | (2014.01) |
| ***E05B 81/16*** | (2014.01) |
| ***E05B 81/30*** | (2014.01) |
| ***E05B 81/42*** | (2014.01) |
| *E05C 3/16* | (2006.01) |

(56) References Cited

U.S. PATENT DOCUMENTS

| | | | |
|---|---|---|---|
| 2012/0256429 | A1 | 10/2012 | Nagaoka et al. |
| 2013/0056996 | A1 | 3/2013 | Akizuki et al. |

FOREIGN PATENT DOCUMENTS

| | | | |
|---|---|---|---|
| JP | 2890842 | B2 | 5/1999 |
| JP | 2001-173289 | A | 6/2001 |
| JP | 3363417 | B2 | 1/2003 |
| JP | 2011-127383 | A | 6/2011 |
| JP | 2011-140803 | A | 7/2011 |
| JP | 4723687 | B1 | 7/2011 |
| JP | 4754413 | B2 | 8/2011 |
| WO | WO-95/16093 | | 6/1995 |
| WO | WO-2011/148697 | A1 | 12/2011 |

OTHER PUBLICATIONS

Office Action dated Apr. 3, 2015 issued in Chinese Application No. 201280072067.5, with English translation.

ACTUATOR UNIT AND DOOR LATCH DEVICE PROVIDED WITH ACTUATOR UNIT

TECHNICAL FIELD

The present invention relates to an actuator unit which shifts a door latch device of a vehicle between a locking state and an unlocking state and the door latch device.

BACKGROUND ART

A door latch device is provided inside a door of a vehicle such as a motor vehicle to hold the door in a closed position. The door latch device can be shifted between a locking state and an unlocking state by driving an actuator unit and operating a manual control means such as a lock knob or the like.

In relation to the above-described actuator unit, the applicant discloses a configuration including a worm wheel which is rotated by a worm secured to a drive shaft of a motor and a lock lever capable of rotating on a shaft center thereof is parallel to a shaft center of the worm wheel in PTLs 1, 2, for example. In this configuration, the worm wheel is rotated by driving the motor, and the lock lever is pressed by projecting portions formed on rotational surfaces of the worm wheel to be shifted between a locking position and an unlocking position, whereby the door latch device connected to the lock lever can be shifted between the locking state and the unlocking state. For example, when the lock lever is shifted from the locking position to the unlocking position, the lock lever is pressed to the unlocking position by the projecting portion formed on one rotational surface of the worm wheel which is driven to rotate by the motor, while the projecting portion formed on the other rotational surface is brought into abutment with the lock lever, whereupon the shifting operation is completed.

Incidentally, in the door latch device, it is necessary to permit a manual operation by a manual control means whether the lock lever is located either in the locking position or in the unlocking position. This requires the actuator unit to be able to rotate only the lock lever between the locking position and the unlocking position wherever the worm wheel stops.

Then, in the case of the actuator unit according to the related art, the projecting portion on each of the rotational surfaces of the worm wheel is configured, for example, so that two tooth portions extend in a 180-degree direction from a rotational center of the worm wheel. Then, a space between both the tooth portions is secured wide, and the projecting portions on both the rotational surfaces have a symmetrical shape. Thus, the manual operation is permitted in an ensured fashion by this configuration.

CITATION LIST

Patent Literature

PTL 1: JP-A-2011-127383
PTL 2: Japanese Patent Publication No. 4754413
PTL 3: Japanese Patent Publication No. 2890842

SUMMARY OF INVENTION

Technical Problem

In recent years, as a so-called smart entry system is propagated, there is a tendency to set short an operation time from the start to end of a locking operation or an unlocking operation. With the related-art door actuator unit described above, however, since the space between the tooth portions which constitute the projecting portion is secured wide, the operation angle of the worm wheel (the projecting portions) through which the lock lever is shifted from the locking position to the unlocking position and is stopped becomes large. When the operation angle of the worm wheel through which the worm wheel rotates for a single operation is large, it is necessary to use a motor having a large output to rotate the worm wheel. Then, when attempting to reduce the operation time by using the large output motor, impact noise generated when the worm wheel stops as a result of the projecting portion being brought into abutment with the lock lever tends to be large. Thus, in order to mitigate the impact, it is necessary that the motor is set in consideration of the balance between the operation time and the impact noise or that an impact absorbing member is placed in the abutment portion between the projecting portions and the lock lever, this calling for an increase in the number of parts involved (refer to PTL 3).

The invention has been made in view of the problem inherent in the related-art actuator unit described above, and an object thereof is to provide an actuator unit which can reduce the operation time of a door latch device without calling for an increase in the number of parts involved.

Solution to Problem

An actuator unit according to the invention includes a drive gear, which is rotatable by driving a motor, and a lock lever, which is rotatable on a predetermined shaft center, the actuator unit being configured to shift a door latch device between a locking state and an unlocking state by rotating the lock lever between a locking position and an unlocking position either by driving the motor or by operating manual control means provided on a door, wherein the drive gear has a first projecting portion, which is formed on a first rotational surface that is one of rotational surfaces on both sides thereof, and a second projecting portion, which is formed on a second rotational surface that is the other rotational surface, wherein the lock lever has a first engagement arm, which is opposed to the first rotational surface of the drive gear so as to be brought into abutment with the first projecting portion, and a second engagement arm, which is opposed to the second rotational surface so as to be brought into abutment with the second projecting portion, wherein the first projecting portion has a pressing surface, which is brought into abutment with the first engagement arm in a first rotational direction of the drive gear, and a locking surface, which is brought into abutment with a rotational end face of the first engagement arm in a second rotational direction which is opposite to the first rotational direction, the pressing surface and the locking surface being provided in a plural number so as to be aligned alternately at intervals along a circumferential direction of the drive gear, wherein the second projecting portion has a pressing surface, which is brought into abutment with the second engagement arm in the second rotational direction of the drive gear, and a locking surface, which is brought into abutment with a rotational end face of the second engagement arm in the first rotational direction, the pressing surface and the locking surface of the second projecting portion being provided in a plural number so as to be aligned alternately at intervals along the circumferential direction of the drive gear, the pressing surface of the second projecting portion being provided back-to-back in relation to the locking surface of the first projecting portion, and the locking surface of the second projecting portion being provided back-to-back in relation to the pressing surface of the first projecting portion, wherein in a case where the lock lever is in the locking position, when the drive gear is rotated in the second rotational direction by the motor, the pressing surface of the second projecting portion is brought into abutment with the second engagement arm in a rotational direction thereof, whereby the lock lever rotates to the unlocking position, and subsequently, the locking surface of the first projecting portion is brought into abutment with the rotational end face of the first engagement arm, whereby the drive gear stops in a first stop position, wherein in a case where the lock lever is in the unlocking position, when the drive gear is rotated in the first rotational direction by the motor, the pressing surface of the first projecting portion is brought into abutment with the first engagement arm in a rotational direction thereof, whereby the lock lever rotates to the locking position, and subsequently, when the locking surface of the second projecting portion is brought into abutment with the rotational end face of the second engagement arm, whereby the drive gear stops in a second stop position, wherein in a case where the drive gear is in the first stop position, the locking surface of the first projecting portion which is in abutment with the rotational end face of the first engagement arm is situated along an arc-shaped first rotational locus of the rotational end face of the first engagement arm, and the locking surface of the second projecting portion, which is provided back-to-back in relation to the pressing surface of the first projecting portion which follows the locking surface thereof in the first rotational direction, is situated along an arc-shaped second rotational locus of the rotational end face of the second engagement arm which is concentric with the first rotational locus, and wherein in a case where the drive gear is in the second stop position, the locking surface of the second projecting portion which is in abutment with the rotational end face of the second engagement arm is situated along the second rotational locus, and the locking surface of the first projecting portion, which is provided back-to-back in relation to the pressing surface of the second projecting portion which follows the locking surface thereof in the second rotational direction, is situated along the first rotational locus.

According to this configuration, the operation angle of the drive gear when the drive gear is rotated by driving the motor which is defined from the start of the rotation of the first and second projecting portions to the start of the abutment thereof with the first and second engagement arms can be minimized while ensuring the smooth operation of the lock lever during the manual operation. Further, the operation angle of the drive gear through which the locking surface of the first or second projecting portion is brought into abutment with the rotational end face of the first or second engagement arm immediately after the lock lever has been shifted to the locking position or the unlocking position can also be minimized. Because of this, even though a low-output motor is used for the motor, the locking operation and the unlocking operation can be executed in an ensured fashion within the desired operation times, and the impact noise produced when the locking surfaces of the drive gear are brought into abutment with the rotational end faces of the first and second engagement arms can be suppressed.

Herein, in the case where the drive gear is in the first stop position, the pressing surface of the first projecting portion, which follows in the first rotational direction the locking surface of the first projecting portion which is in abutment with the rotational end face of the first engagement arm, intersects an extension of the first rotational locus, and in the case where the drive gear is in the second stop position, the pressing surface of the second projecting portion, which follows in the second rotational direction the locking surface of the second projecting portion which is in abutment with the rotational end face of the second engagement arm, intersects an extension of the second rotational locus. In this case, when adopting a configuration in which, the operation angles of the drive gear when the locking operation and the unlocking operation are executed can be reduced.

Further, the first projecting portion has three first tooth portions which are disposed at equal angular intervals along the circumferential direction of the drive gear, and the pressing surface is provided on an end face of each of the first tooth portions which is oriented in the first rotational direction, while the locking surface is provided on an end face of each of the first tooth portions which is oriented in the second rotational direction, and the second projecting portion has three second tooth portions which are disposed at equal angular intervals along the circumferential direction of the drive gear, and the pressing surface is provided on an end face of each of the second tooth portions which is oriented in the second rotational direction, while the locking surface is provided on an end face of each of the second tooth portions which is oriented in the first rotational direction. When adopting a configuration in which, the operation angles of the drive gear when the locking operation and the unlocking operation are executed can be reduced.

Further, the first projecting portion and the second projecting portion are disposed back-to-back into a symmetrical configuration on both the sides of the drive gear. When adopting a configuration in which, the operation angles of the drive gear when the locking operation and the unlocking operation are executed can be reduced. Further, the overall configuration can be simplified, thereby making it possible to facilitate the control of the locking operation and the unlocking operation.

Advantageous Effects of Invention

According to the invention, the operation angle of the drive gear when the drive gear is rotated by driving the motor which is defined from the start of the rotation of the first and second projecting portions to the start of the abutment thereof with the first and second engagement arms can be minimized while ensuring the smooth operation of the lock lever during the manual operation. Further, the operation angle of the drive gear through which the locking surface of the first or second projecting portion is brought into abutment with the rotational end face of the first or second engagement arm immediately after the lock lever has been shifted to the locking position or the unlocking position can also be minimized. Because of this, even though a low-output motor is used for the motor, the locking operation and the unlocking operation can be executed in an ensured fashion within the desired operation times, and the impact noise produced when the locking surfaces of the drive gear are brought into abutment with the rotational end faces of the first and second engagement arms can be suppressed.

BRIEF DESCRIPTION OF DRAWINGS

FIG. 6 shows plan views showing relationships between first and second projecting portions and first and second engagement arms in such a state that the lock lever is in an unlocking position, in which FIG. 6(A) is a plan view as seen from one side of the worm wheel where one rotational surface is located, and FIG. 6(B) is a plan view as seen from the other side of the worm wheel where the other rotational surface is located.

FIG. 7 shows plan views as seen from the side of the worm wheel where the one rotational surface is located which show the relationships between the first and second projecting portions and the first and second engagement arms, in which FIG. 7(A) is a plan view showing a state in which the lock lever is in the unlocking position, and FIG. 7(B) is a plan view showing a state in which the lock lever is in a locking position.

FIG. 8 shows explanatory plan views as seen from the one side of the worm wheel where the one rotational surface is located which show the operations of the worm wheel and the lock lever, in which FIG. 8(A) is an explanatory plan view showing a state in which the lock lever is in the unlocking position, FIG. 8(B) is an explanatory plan view showing a state in which a first projecting portion starts to be brought into abutment with the lock lever as a result of a rotation of the worm wheel from the state shown in FIG. 8(A), FIG. 8(C) is an explanatory plan view showing a state in which the worm wheel is rotated further from the state shown in FIG. 8(B) to thereby rotate the lock lever, FIG. 8(D) is an explanatory plan view showing a state in which the worm wheel is rotated further from the state shown in FIG. 8(C) to thereby rotate the lock lever further, and FIG. 8(E) is an explanatory plan view showing a state in which the worm wheel is rotated further from the state shown in FIG. 8(D) to thereby rotate the lock lever further to be located in the locking position.

DESCRIPTION OF EMBODIMENTS

Hereinafter, an actuator unit according to the invention will be described in detail by reference to the accompanying drawings by taking as an example a preferred embodiment in relation to a door latch device which installs this actuator unit.

Figure 1:
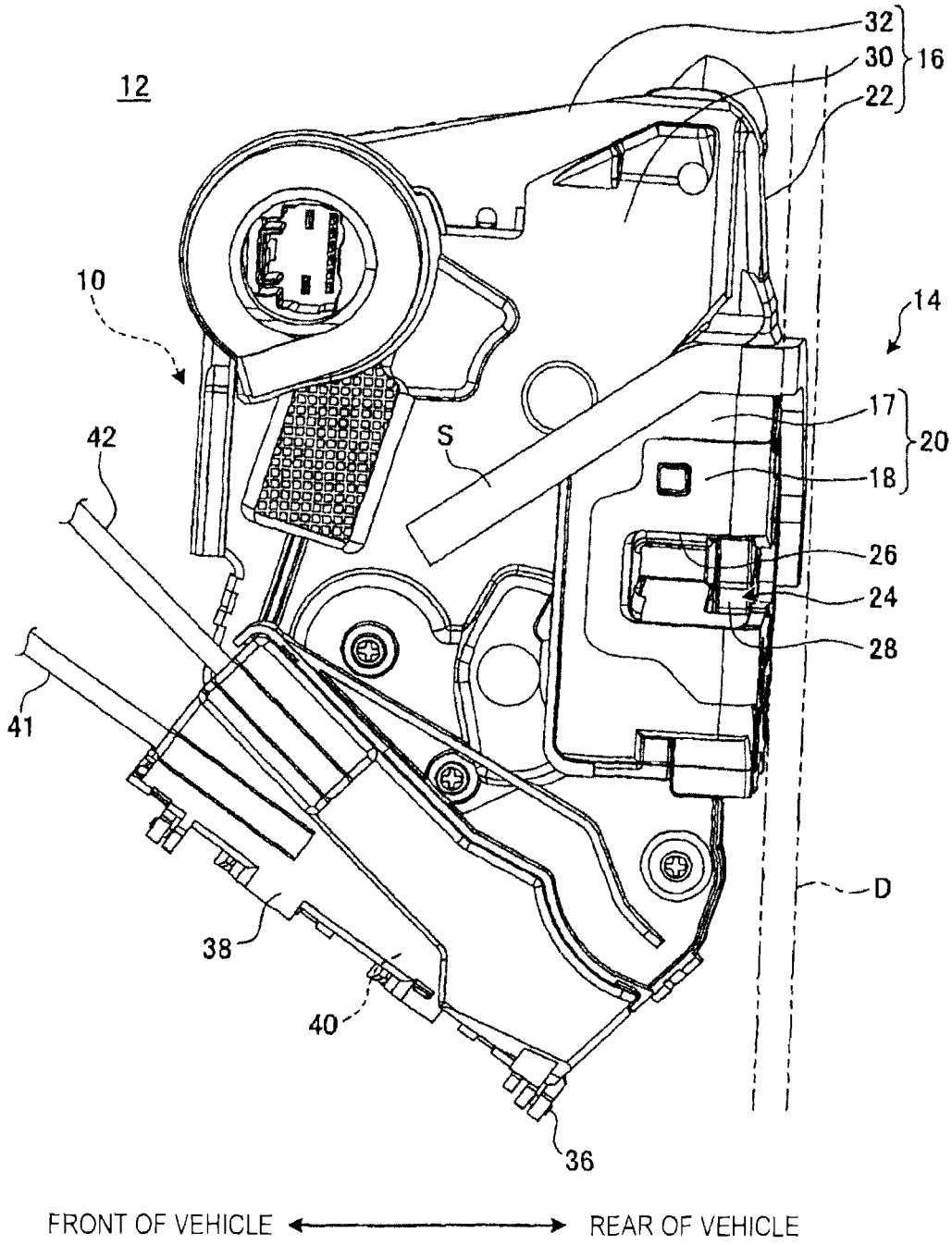
FIG. 1 is a side view of a door latch device including an actuator unit according to an embodiment of the invention which is seen from an inside of a passenger compartment of a vehicle.
Figure 2:
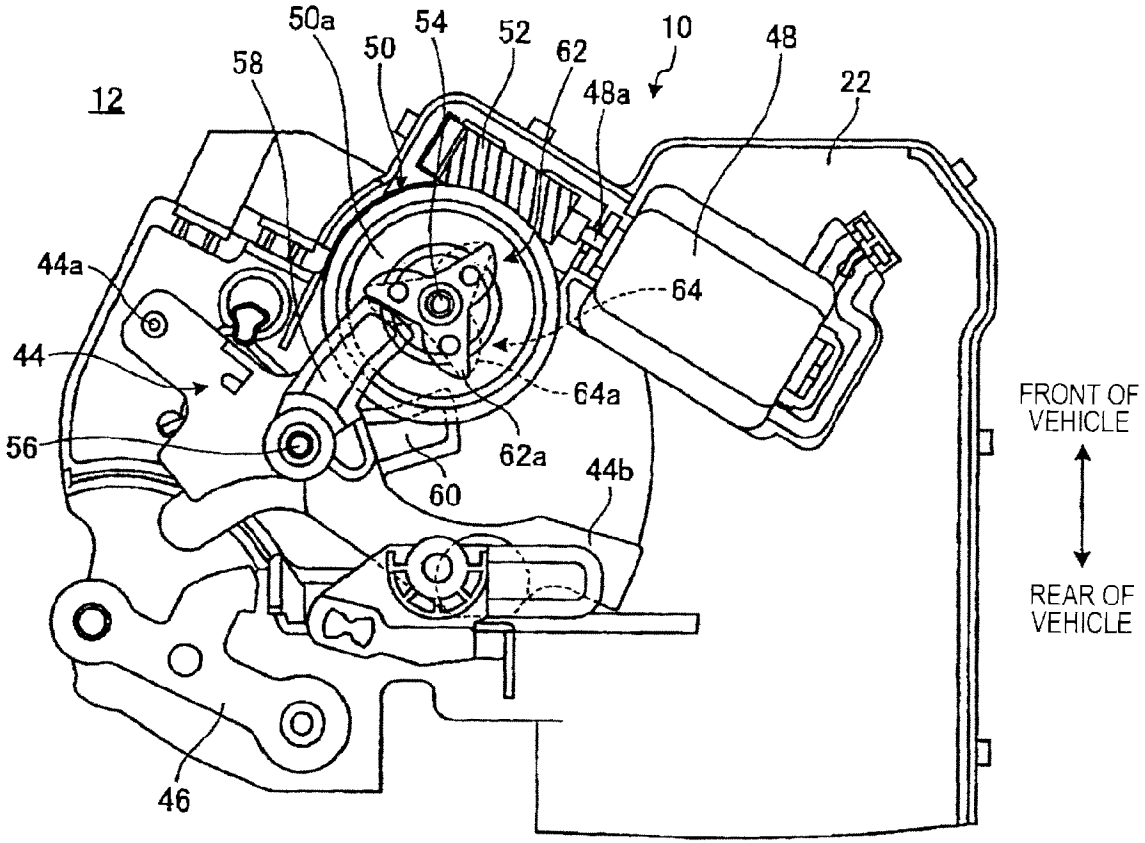
FIG. 2 is a side view showing schematically an interior construction of the door latch device which is in an unlocking state.
Figure 3:
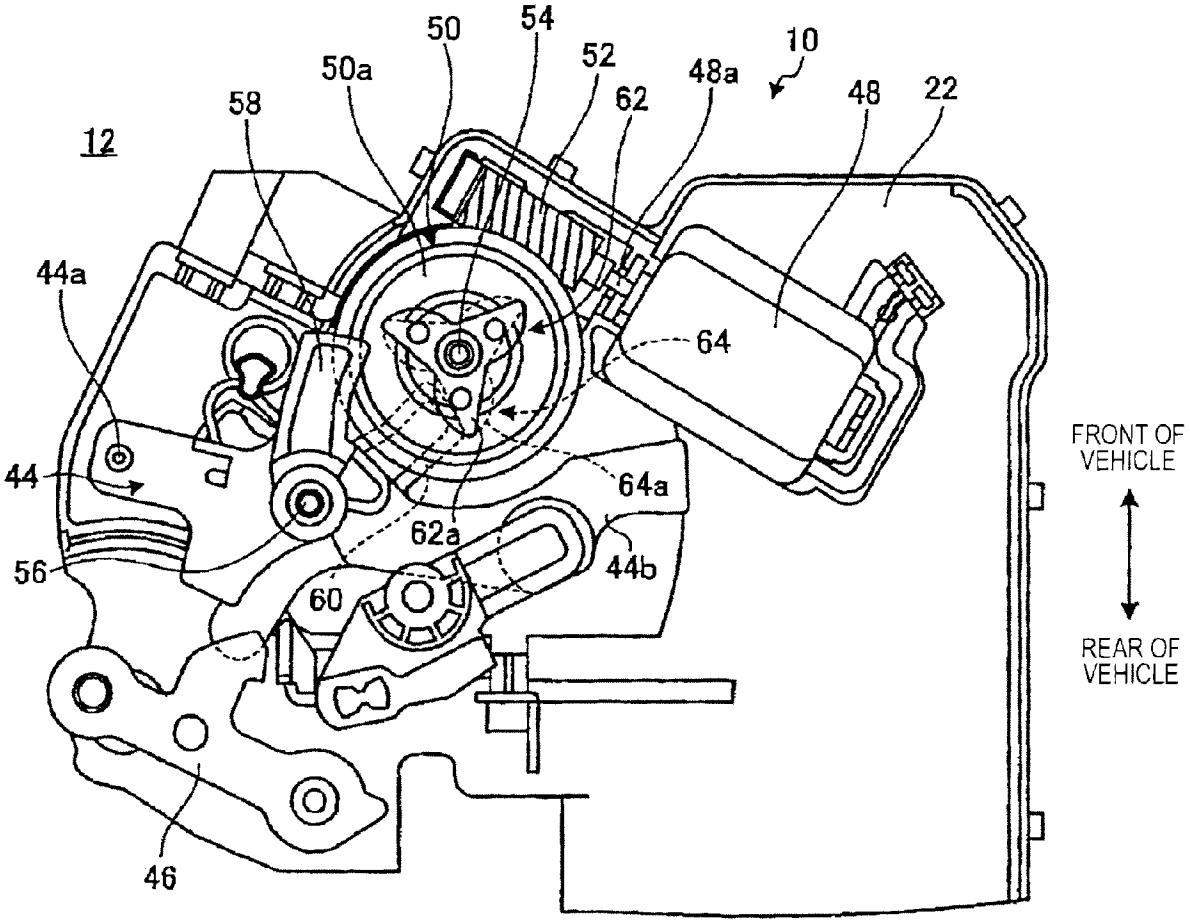
FIG. 3 is a side view showing schematically an interior construction of the door latch device which is in a locking state.

FIG. 1 is a side view of a door latch device 12 including an actuator unit 10 according to an embodiment of the invention which is seen from an inside of a passenger compartment of a vehicle and shows a state in which the door latch device 12 is mounted on a door panel of a door D (which is a front side door in FIG. 1) and is seen from the inside of the passenger compartment. FIG. 2 is a side view showing schematically an interior construction of the door latch device 12 which is in an unlocking state, and FIG. 3 is a side view showing schematically an interior construction of the door latch device 12 which is in a locking state. In the door latch device 12 mounted as shown in FIG. 1, the left of FIG. 1 denotes the front of the vehicle, the right denoting the rear of the vehicle. However, the orientation of the door latch device 12 may change depending upon a vehicle model in which the door latch device 12 is mounted or a mounting position thereof.

As shown in FIGS. 1 to 3, the door latch device (the door lock system) 12 includes a meshing unit 14 which is fixed to an inner surface of the door panel which makes up a rear end of an inboard side of the door D with a plurality of bolts (not shown) and which holds and locks the door D in a closed state and the actuator unit 10 which is assembled to the meshing unit 14 and which shifts electrically the door latch device 12 between the locking state and the unlocking state, and the meshing unit 14 and the actuator unit 10 are housed in a lock case 16.

The meshing unit 14 includes a body 20 which is made up of a body main portion 17 made from a synthetic resin which is fixed to the door D with the bolts and a cover plate portion 18 made of a metal which is fixed to a rear side of the body main portion 17, and this body 20 is housed within a case 22 which makes up the lock case 16 in such a state that the body 20 is partially exposed. A meshing mechanism 24, configured to be brought into engagement with a striker (not shown) which is secured to a vehicle body so as to hold the door in a closed state, is housed within a housing space portion which is defined by the body main portion 17 and the cover plate portion 18, that is, an interior space in the body 20. A striker entrance groove 26 is provided in the body 20 for entrance of the striker when the door is closed.

A known latch and ratchet mechanism should be used as the meshing mechanism 24, and in this case, the meshing mechanism 24 has a latch 28 which is supported in a pivotable fashion by a longitudinal shaft (not shown) within the body 20 so as to be brought into engagement with the striker and a ratchet (not shown) which is supported in a pivotable fashion by a longitudinally oriented shaft (not shown) within the body 20 so as to be brought into engagement with or disengagement from the latch 28. In this meshing mechanism 24, when the door D is closed, the striker, which is mounted on the vehicle body, enters the striker entrance groove 26 to be brought into engagement with the latch 28, while the ratchet is brought into engagement with the latch 28 in a direction in which the latch 28 is prevented from rotating in an opening direction thereof, whereby the door D is retained in the closed state. Additionally, by manually operating a key cylinder or a lock knob (a door knob), a door handle or the like, the engagement of the latch 28 with the ratchet is released, whereby the closed state of the door D can be released.

The lock case 16 houses the meshing unit 14 in such a state that the meshing unit 14 is partially exposed. The actuator unit 10 and other constituent parts including various mechanism parts such as levers and a group of connection terminals are housed and disposed in an interior space of the lock case 16. The lock case 16 includes the case 22, having substantially an L shape when seen from thereabove and made from a synthetic resin, which is fixed to the body 20, a cover 30, made from a synthetic resin, which closes a housing space portion defined within the case 22 and a waterproof cover 32, made from a synthetic resin, which prevents the infiltration of rain water or the like into the interior of the case 22. An auxiliary cover 38, configured to be rotated towards the interior of the passenger compartment on a hinge 36 so as to be opened or closed, is placed at a lower portion of the cover 30. The auxiliary cover 38 is designed to cover a cable holding portion 40 which is formed at a lower end of the cover 30. A cable 41 and a cable 42 are provided in the cable holding portion 40, the cable 41 extending from a lock knob, which is not shown, to be connected to a lock lever 44 which is disposed within the lock case 16, the cable 42 extending from an inside handle, which is not shown, to be connected to an inside lever 46 which is disposed within the lock case 16. Reference character S in FIG. 1 denotes a long belt-shaped waterproof seal which is affixed to a passenger compartment-side side surface of the cover 30 so as to prevent the infiltration of rain water or the like into the interior of the passenger compartment.

Next, a specific configuration example of the actuator unit 10 which shifts the door latch device 12 between the locking state and the unlocking state will be described.

As shown in FIGS. 2 and 3, the actuator unit 10 includes a motor (an electric motor) 48, a worm wheel 50 and the lock lever 44, and these constituent parts are housed in the interior of the case 22.

The motor (the electric motor) 48 can be driven to rotate in an arbitrary direction (a forward or backward direction) according to the direction of an electric current to be supplied, and a worm 52 is secured to a drive shaft 48*a* of the motor 48. The worm 52 is a cylindrical member having a plurality of thread grooves on an outer circumferential surface thereof, and the worm 52 has, for example, two thread grooves.

The worm wheel (the drive gear) 50 is a circular disc-shaped gear wheel having inclined teeth on an outer circumferential surface thereof. The worm wheel 50 is provided rotatably in the interior of the case 22 in such a state that a shaft center of a support shaft portion 54 which constitutes a rotational center of the worm wheel 50 is at right angles to the drive shaft 48*a* of the motor 48 and that the inclined teeth on the outer circumferential surface are in mesh with the worm 52.

The lock lever 44 is supported pivotally by a pivot 56 which is placed parallel to the support shaft portion 54 of the worm wheel 50 and is hence provided so as to rotate on a shaft center of the pivot 56 in the interior of the case 22. The lock lever 44 can rotate, for example, between an unlocking position shown in FIG. 2 and a locking position shown in FIG. 3 where the lock lever 44 rotates in a counterclockwise direction from the unlocking position based on a manual operation of a lock knob which is provided on an inner side of the door D or a key cylinder which is provided on an outer side of the door D, the lock knob and the key cylinder constituting a manual control means, and further a rotation of the worm wheel 50 by driving the motor 48 (the worm 52). In the lock lever 44, a cable 41 which is connected to the lock knob is connected to a connecting portion 44*a* which projects in a leftward direction from the pivot 56 in FIGS. 2 and 3, and various link levers or key levers (not shown) which are connected to the key cylinder are connected to an operating arm portion 44*b* which projects in a rightward direction from the pivot 56.

Figure 4:
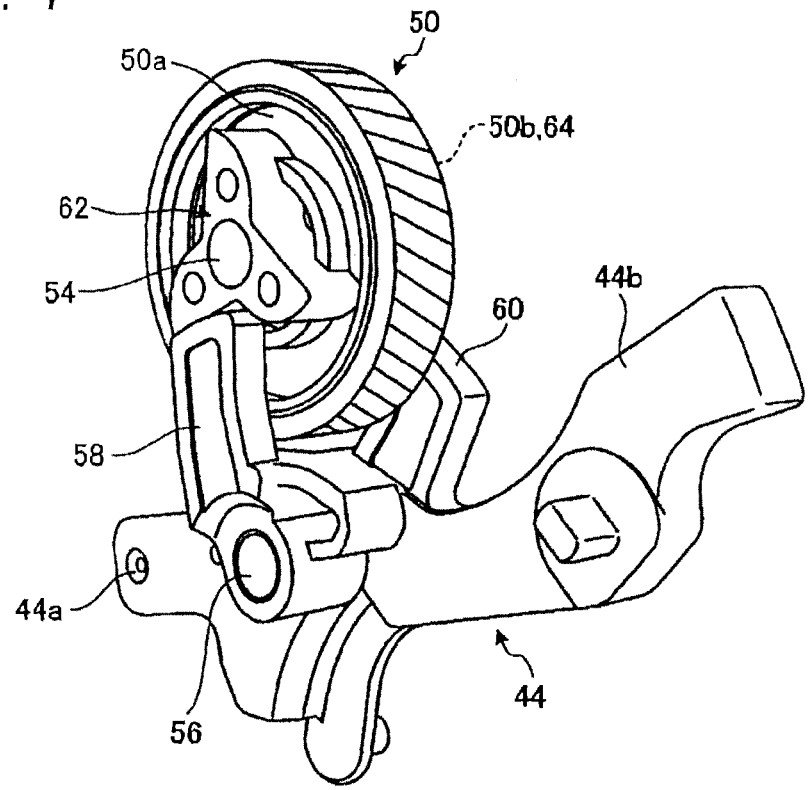
FIG. 4 is a perspective view showing a positional relationship between a worm wheel and a lock lever.
Figure 5:
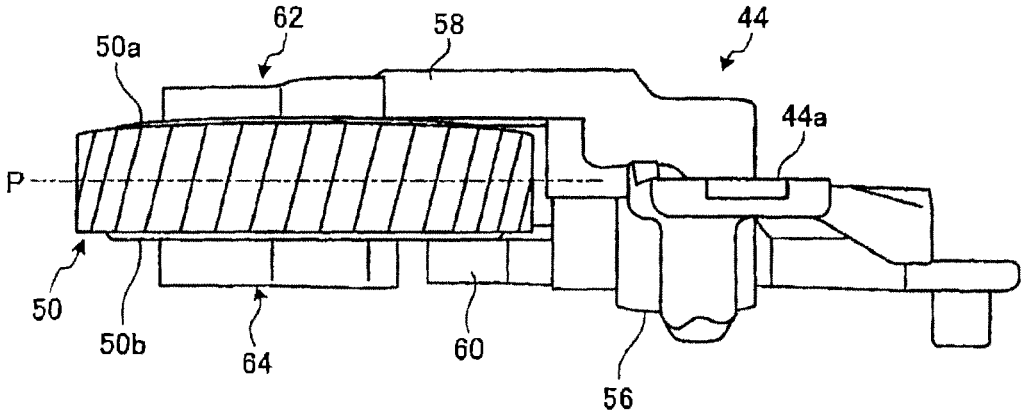
FIG. 5 is a front view showing a positional relationship between the worm wheel and the lock lever.

Further, a first engagement arm 58 and a second engagement arm 60 which extend from the pivot 56 in centrifugal directions are provided on the lock lever 44. As shown in FIGS. 4 and 5, the first engagement arm 58 and the second engagement arm 60 are provided so as not only to be spaced apart from each other in the direction of an axis of the pivot 56 in such a way as to hold rotational surfaces (side surfaces) 50*a*, 50*b* on both sides of the worm wheel 50 therebetween but also to be spaced a predetermined angle apart from each other in relation to a rotational direction of the lock lever 44.

The first engagement arm (the lever member) 58 extends so as to be close and opposed to the rotational surface 50*a* of the worm wheel 50 and can be brought into abutment with a first projecting portion (a first engagement projecting portion) 62 which is provided on the rotational surface 50*a* (refer to FIG. 6(A)). On the other hand, the second engagement arm (the lever member) 60 extends so as to be close and opposed to the other rotational surface 50*b* of the worm wheel 50 and can be brought into abutment with a second projecting portion (a second engagement projecting portion) 64 which is provided on the rotational surface 50*b* (refer to FIG. 6(B)). The first and second engagement arms 58, 60 are set to such lengths that the first and second engagement arms 58, 60 do not run across a rotational axis of the worm wheel 50 when the lock lever 44 rotates from the unlocking position to the locking position and in a reverse direction thereto.

The first and second projecting portions 62, 64 and the first and second engagement arms 58, 60 constitute together first and second power transmission mechanisms (first and second transmission mechanisms) which transmit the rotation of the worm wheel 50 based on the driving of the motor 48 to the lock lever 44 so as to rotate it, respectively.

In relation to the first and second power transmission mechanisms, firstly, the configurations of the first and second projecting portions 62, 64 which sit on the worm wheel 50 will be described.

Figure 6:
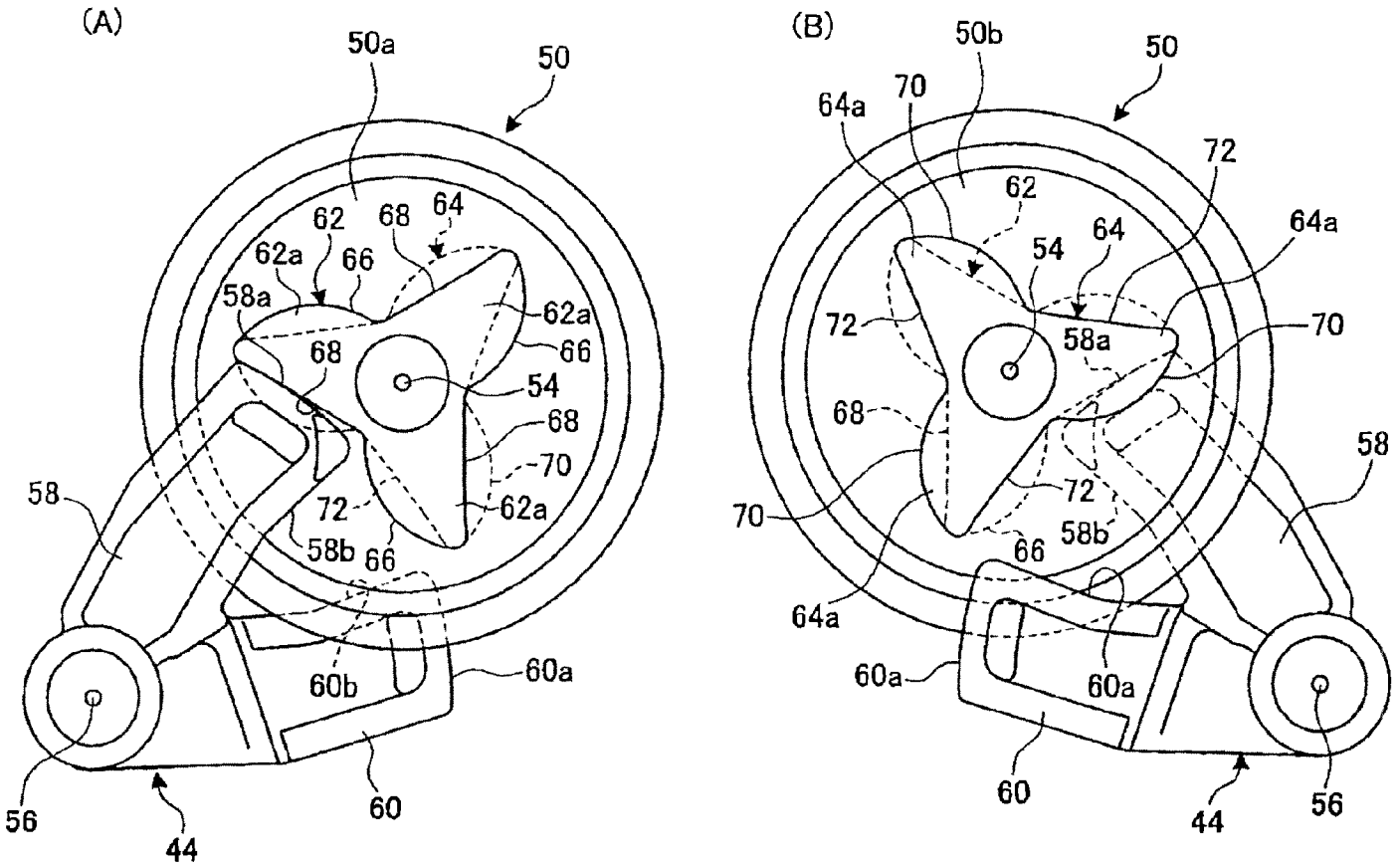
Figure 7:
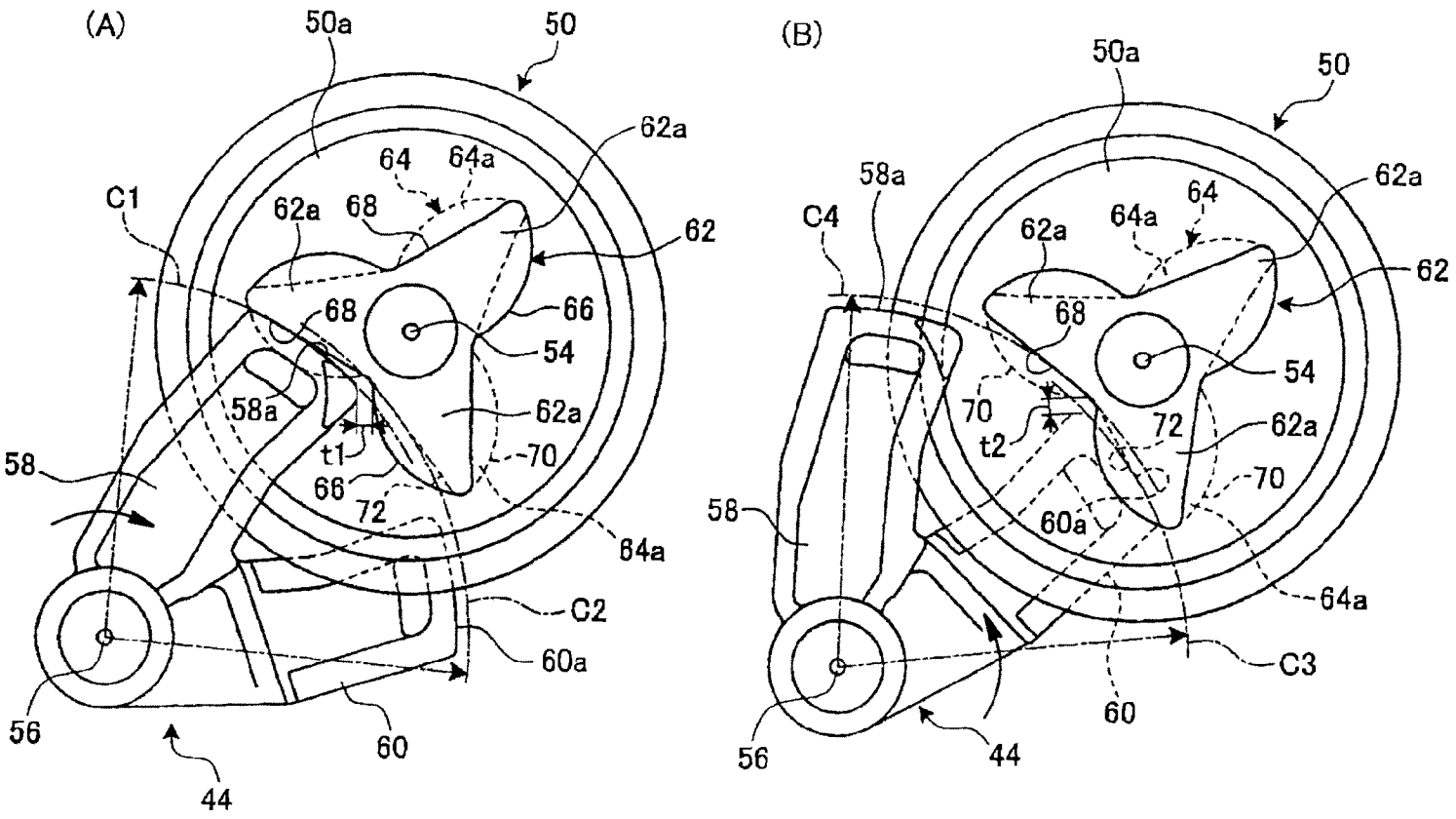

FIG. 6 shows plan views showing relationships between the first and second projecting portions 62, 64 and the first and second engagement arms 58, 60 in such a state that the lock lever 44 is in the unlocking position, in which FIG. 6(A) is a plan view as seen from the side of the worm wheel 50 where the rotational surface 50*a* is located, and FIG. 6(B) is a plan view as seen from the other side of the worm wheel 50 where the other rotational surface 50*b* is located. Additionally, FIG. 7 shows plan views as seen from the side of the worm wheel 50 where the rotational surface 50*a* is located which show the relationships between the first and second projecting portions 62, 64 and the first and second engagement arms 58, 60, in which FIG. 7(A) is a plan view showing a state in which the lock lever 44 is in the unlocking position, and FIG. 7(B) is a plan view showing a state in which the lock lever 44 is in the locking position. In FIGS. 6 and 7, only main parts of the worm wheel 50 and the lock lever 44 are depicted with the other elements omitted.

The first projecting portion 62 projects above the rotational surface 50*a* of the worm wheel 50 to thereby be brought into abutment with the first engagement arm 58 of the lock lever 44 (refer to FIGS. 5 and 6(A)). The second projecting portion 64 projects above the other rotational surface 50*b* of the worm wheel 50 to thereby be brought into abutment with the second engagement arm 60 of the lock lever 44 (refer to FIGS. 5 and 6(B)).

As shown in FIG. 6(A), the first projecting portion 62 includes three first tooth portions 62*a* each having a substantially triangular shape (a wave-like shape) which projects from the support shaft portion 54 so as to be tapered off radially outwards, and the three first tooth portions 62*a* are provided circumferentially at equal angular intervals about the shaft center of the support shaft portion 54. In FIG. 6(A), each first tooth portion 62*a* includes a curved surface (a pressing surface) 66 which constitutes a front end face in a clockwise direction about the support shaft portion 54 and which is curved outwards relative largely and a locking surface (an abutment surface, a stopper surface) 68 which constitutes a rear end face in the clockwise direction and which is curved slightly inwards. For example, the curved surface 66 curves outwards with a first curvature, and the locking surface 68 curves inwards with a second curvature which is smaller than the first curvature. Almost similarly, as shown in FIG. 6(B), the second projecting portion 64 includes three second tooth portions 64*a* each having a substantially triangular shape which projects from the support shaft portion 54 so as to be tapered off radially outwards, and the three second tooth portions 64*a* are provided circumferentially at equal angular intervals about the shaft center of the support shaft portion 54. In FIG. 6(B), each second tooth portion 64*a* includes a curved surface (a pressing surface) 70 which constitutes a front end face in the clockwise direction about the support shaft portion 54 and which is curved outwards relative largely and a locking surface (an abutment surface, a stopper surface) 72 which constitutes a rear end face in the clockwise direction and which is curved slightly inwards.

As is understood from FIGS. 6(A) and 6(B), the first and second projecting portions 62, 64 are provided so as to project axially outwards of the support shaft portion 54 on the rotational surfaces 50*a*, 50*b* on both the sides of the worm wheel 50 and are disposed back-to-back in relation to the rotational surfaces 50*a*, 50*b* of the worm wheel 50 in a symmetrical (axially symmetrical) fashion. In other words, the first and second projecting portions 62, 64 are formed into an orthogonally symmetrical relationship with respect to an imaginary plane P (refer to FIG. 5) which includes the thickness center line of the worm wheel 50 and is at right angles to the support shaft portion 54 (a symmetrical relationship with respect to the plane P).

Consequently, a specific first tooth portion 62*a* and a specific second tooth portion 64*a* are disposed so as to overlap generally each other when seen from the side of the worm wheel 50 where the rotational surface 50*a* is located as shown in, for example, FIG. 6(A), and the specific first and second tooth portions 62*a*, 64*a* are disposed so that the curved surface 70 of the second tooth portion 64*a* corresponds to the locking surface 68 of the first tooth portion 62*a* (in a back-to-back fashion), while the locking surface 72 of the second tooth portion 64*a* corresponds to the curved surface 66 of the first tooth portion 62*a* (in a back-to-back fashion).

Next, the configurations of the first and second engagement arms 58, 60 which sit on the lock lever 44 will be described.

When it is seen from thereabove as in FIG. 6, the first engagement arm 58 curves slightly towards the second engagement arm 60 halfway outwards its extension while extending from the pivot 56 in a centrifugal direction and has a rotational end face (a distal end face) 58*a* which curves slightly so as to follow an arc which is centered at the pivot 56 at an outer distal end edge thereof. When it is seen from thereabove as in FIG. 6, the second engagement arm 60 curves slightly towards the first engagement arm 58 halfway outwards its extension while extending from the pivot 56 in the centrifugal direction and has a rotational end face (a distal end face) 60*a* which curves slightly so as to follow an arc which is centered at the pivot 56 at an outer distal end edge thereof.

In the first and second power transmission mechanisms described above, for example, as shown in FIGS. 2 and 7(A), when the lock lever 44 is in the unlocking position, the first engagement arm 58 of the lock lever 44 is situated within a rotational locus of the first projecting portion 62 of the worm wheel 50, and the second engagement arm 60 is situated outside a rotational locus of the second projecting portion 64 of the worm wheel 50, and additionally, the locking surface 68 of the specific first tooth portion 62*a* is in abutment with or close to the rotational end face 58*a* of the first engagement arm 58. Hereinafter, as shown in FIGS. 2 and 7(A), a position (an angular position) of the worm wheel 50 resulting when the lock lever 44 is in the unlocking position and the door latch device 12 is in the unlocking state will be called a first stop position (a first angular position).

In this state, a curved surface 66 of a first tooth portion 62*a* which lies adjacent to the specific first tooth portion 62*a* is situated in a position which lies adjacent to a corner portion of the rotational end face 58*a* of the first engagement portion 58, that is, for example, in a position which is spaced by a slight gap t1 away form the corner portion of the rotational end face 58*a* (refer to FIG. 7(A)). Further, in this state, as shown in FIG. 7(A), at least part of the locking face 68 of the specific first tooth portion 62*a* is situated on an arc C1 which is centered at the shaft center of the pivot 56 of the lock lever 44. Additionally, at least part of the locking surface 72 of the second tooth portion 64*a* of the second projecting portion 64 which corresponds to the first tooth portion 62*a* which has the curved surface 66 which lies in the position which is spaced by the gap t1 away from the rotational end face 58*a* of the first engagement arm 58 is situated on an arc C2 which is centered at the shaft center of the pivot 56 of the lock lever 44. Namely, the arc C1 and the arc C2 are concentric circles which are centered at the pivot 56, and the locking surfaces 68 of the first projecting portion 62 and the locking surfaces 72 of the second projecting portion 64 are situated on the concentric circles. Additionally, in this embodiment, as shown in FIG. 7(A), the rotational end face 58*a* of the first engagement arm 58 rotates along the arc C1, and the rotational end face 60*a* of the second engagement arm 60 rotates along the arc C2. In other words, when the worm wheel 50 is in the first stop position, the locking surface 68 of the specific first tooth portion 62*a* which is brought into abutment with the rotational end face 58*a* of the first engagement arm 58 and the locking surface 72 of the second tooth portion 64*a* which lies adjacent to the specific first tooth portion 62*a* and corresponds to the first tooth portion 62*a* which has the curved surface 66 which is situated in the position which is spaced by the gap t1 away from the rotational end face 58*a* of the first engagement arm 58 are situated along the rotational loci of the rotational end face 58*a* of the first engagement portion 58 and the rotational end face 60*a* of the second engagement arm 60 which are concentric with each other.

When a key cylinder or a lock knob is operated, as shown in FIGS. 3 and 7(B), the lock lever 44 rotates through a predetermined angle in a locking direction (a counterclockwise direction in FIG. 7(B)) from the unlocking position shown in FIGS. 2 and 7(A) and stops in the locking position.

Here, as described above, when the worm wheel 50 is in the first stop position shown in FIG. 7(A), the locking surface 68 of the first projecting portion 62 and the locking surface 72 of the second projecting portion 64 are situated on the concentric circles as shown in FIGS. 3 and 7(B). Because of this, as shown in FIG. 7(A), the first projecting portion 62 of the worm wheel 50 which stays stationary in the first stop position is situated outside the rotational locus of the rotational end face 58*a* of the first engagement arm 58 of the lock lever 44. Further, the second projecting portion 64 of the worm wheel 50 which stays stationary in the first stop position is situated outside the rotational locus of the rotational end face 60*a* of the second engagement arm 60 of the lock lever 44. Because of this, even though the lock lever 44 rotates from the unlocking position to the locking position with the worm wheel 50 staying stationary in the first stop position, the first and second engagement arms 58, 60 are never brought into abutment with the first and second projecting portions 62, 64 to press them although the first and second engagement arms 58, 60 may be brought into sliding contact with the first and second projecting portions 62, 64. Thus, even though the lock lever 44 is rotated by the manual operation, the worm wheel 50 is prevented from rotating in association with the rotation of the lock lever 44. Consequently, the rotation of the worm wheel 50 or the motor 48 based on the locking operation of the key cylinder and the lock knob is prevented. This reduces the resistance produced at the time of locking operation, whereby the locking operation can be performed with a light force. Further, this can prevent the motor 48 from rotating reversely to thereby prevent the deterioration of the motor 48 which would otherwise be caused by the reverse rotation of the motor 48 as a generator.

Moreover, the curved surface 66 of the first tooth portion 62*a* which lies adjacent to the first tooth portion 62*a* having the locking surface 68 which is in abutment with or close to the rotational end face 58*a* of the first engagement arm 58 is disposed close to the first engagement arm 58 via the slight gap t1 in such a state that the worm wheel 50 stays stationary in the first stop position. Because of this, even though the worm wheel 50 attempts to rotate excessively due to an overrun or the like which occurs immediately after the lock lever 44 is rotated from the locking position to the unlocking position by rotationally driving the worm wheel 50, which will be described later, a forward rotation of the worm wheel 50 is prevented by the engagement between the rotational end face 58*a* of the first engagement arm 58 and the locking surface 68. Further, a reverse rotation of the worm wheel 50 is restricted to a slight rotational angle by the abutment of the corner portion of the rotational end face 58*a* of the first engagement arm 58 with the curved surface 66 via the gap t1. Consequently, since the worm wheel 50 stops in the first stop position, the resistance at the time of locking operation can be reduced.

On the other hand, as shown in FIGS. 3 and 7(B), when the lock lever 44 is in the locking position, the first engagement arm 58 of the lock lever 44 is situated outside the rotational locus of the first projecting portion 62 of the worm wheel 50, and the second engagement arm 60 is situated within the rotational locus of the second projecting portion 64 of the worm wheel 50. Additionally, the locking surface 72 of the specific second tooth portion 64*a* is in abutment with or close to the rotational end face 60*a* of the second engagement arm 60. Hereinafter, as shown in FIGS. 3 and 7(B), a position (an angular position) of the worm wheel 50 resulting when the lock lever 44 is in the locking position and the door latch device 12 is in the locking state will be called a second stop position (a second angular position).

Substantially similar to the case where the door latch device 12 is in the unlocking state as described above, in this state, a curved surface 70 of a second tooth portion 64*a* which lies adjacent to the specific second tooth portion 64*a* is situated in a position which lies adjacent to a corner portion of the rotational end face 60*a* of the second engagement arm 60, that is, for example, a position which is spaced by a slight gap t2 away from the corner portion of the rotational end face 60*a* (refer to FIG. 7(B)). Further, in this state, too, as shown in FIG. 7(B), at least part of the locking surface 72 of the specific second tooth portion 64*a* is situated on an arc C3 which is centered at the shaft center of the pivot 56 of the lock lever 44. Additionally, at least part of the locking surface 68 of the first tooth portion 62*a* of the first projecting portion 62 which corresponds to the second tooth portion 64*a* which has the curved surface 70 which is situated in the position which is spaced by the gap t2 away from the rotational end face 60*a* of the second engagement arm 60 is situated on an arc C4 which is centered at the shaft center of the pivot 56 of the lock lever 44. Namely, the arc C3 and the arc C4 are concentric circles which are centered at the pivot 56, and the locking surfaces 72 of the second projecting portion 64 and the locking surfaces 68 of the first projecting portion 62 are situated on the concentric circles. Additionally, in this embodiment, as shown in FIG. 7(B), the rotational end face 58*a* of the first engagement arm 58 rotates along the arc C4, and the rotational end face 60*a* of the second engagement arm 60 rotates along the arc C4. In other words, when the worm wheel 50 is in the second stop position, the locking surface 72 of the specific second tooth portion 64*a* which is brought into abutment with the rotational end face 60*a* of the second engagement arm 60 and the locking surface 68 of the first tooth portion 62*a* which lies adjacent to the specific second tooth portion 64*a* and corresponds to the second tooth portion 64*a* which has the curved surface 70 which is situated in the position which is spaced by the gap t2 away from the rotational end face 60*a* of the second engagement arm 60 are situated along the rotational loci of the rotational end face 58*a* of the first engagement arm 58 and the rotational end face 60*a* of the second engagement arm 60 which are concentric with each other.

In this embodiment, since the first projecting portion 62 and the second projecting portion 64 are disposed back-to-back into the symmetrical configuration, the gap t1 and the gap t2 are the same, the arc C1 and the arc C3 have the same diameter, and the arc C2 and the arc C4 have the same diameter.

When the key cylinder or the lock knob is operated from the locking position shown in FIGS. 3 and 7(B) to unlock the door D, as shown in FIGS. 2 and 7(A), the lock lever 44 rotates through a predetermined angle in an unlocking direction (a clockwise direction in FIG. 7(A)) and then stops in the unlocking position.

In this case, too, the worm wheel 50 stays stationary in the second stop position shown in FIG. 7(B), and the locking surface 68 of the first projecting portion 62 and the locking surface 72 of the second projecting portion 64 are situated on the concentric circles. Because of this, as shown in FIG. 7(B), the first projecting portion 62 of the worm wheel 50 which stays stationary in the second stop position is situated outside the rotational locus of the rotational end face 58*a* of the first engagement arm 58 of the lock lever 44. Further, the second projecting portion 64 of the worm wheel 50 which stays stationary in the second stop position is situated outside the rotational locus of the rotational end face 60*a* of the second engagement arm 60 of the lock lever 44. Consequently, even though the lock lever 44 is rotated from the locking position to the unlocking position by the manual operation with the worm wheel 50 staying stationary in the second stop position, the first and second engagement arms 58, 60 are never brought into abutment with the first and second projecting portions 62, 64 to press them although the first and second engagement arms 58, 60 may be brought into sliding contact with the first and second projecting portions 62, 64. Thus, even though the lock lever 44 is rotated by the manual operation, the worm wheel 50 is prevented from rotating in association with the rotation of the lock lever 44.

In addition, also in such a state that the worm wheel 50 stays stationary in the second stop position, the curved surface 70 of the second tooth portion 64*a* which lies adjacent to the second tooth portion 64*a* having the locking surface 72 which is in abutment with (or close to) the rotational end face 60*a* of the second engagement arm 60 is disposed close to the second engagement arm 60 via the slight gap t2. Because of this, substantially similar to the case where the worm wheel 50 stays stationary in the first stop position, even though the worm wheel 50 attempts to rotate excessively due to the overrun or the like which occurs immediately after the lock lever 44 is rotated by rotationally driving the worm wheel 50, a forward and reverse rotations of the worm wheel 50 are prevented by the locking surface 72 and the curved surface 70, the worm wheel 50 stays stationary in the second stop position in an ensured fashion and this can reduce the resistance at the time of locking operation.

Next, referring mainly to FIG. 8, electric shifting operations of the door latch device 12 between the unlocking state and the locking state by rotating the worm wheel 50 by driving the motor 48 and rotating the lock lever 44 from the unlocking position to the locking position will be described.

Figure 8:
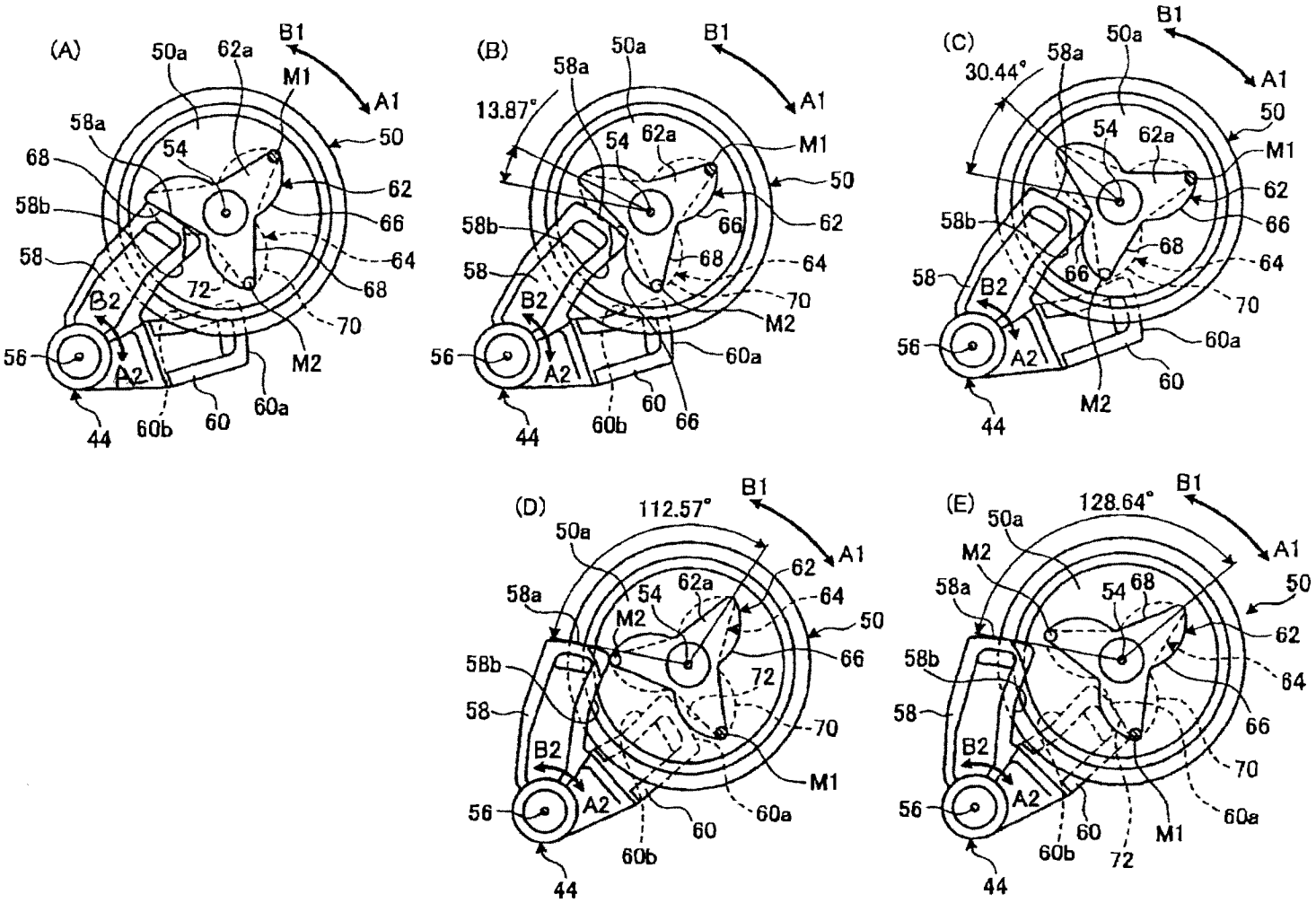

FIG. 8 shows explanatory plan views as seen from the one side of the worm wheel 50 where the rotational surface 50*a* is located which show the operations of the worm wheel 50 and the lock lever 44, in which FIG. 8(A) is an explanatory plan view showing a state in which the lock lever 44 is in the unlocking position, FIG. 8(B) is an explanatory plan view showing a state in which the first projecting portion 62 starts to be brought into abutment with the lock lever 44 as a result of a rotation of the worm wheel 50 from the state shown in FIG. 8(A), FIG. 8(C) is an explanatory plan view showing a state in which the worm wheel 50 is rotated further from the state shown in FIG. 8(B) to thereby rotate the lock lever 44, FIG. 8(D) is an explanatory plan view showing a state in which the worm wheel 50 is rotated further from the state shown in FIG. 8(C) to thereby rotate the lock lever 44 further, and FIG. 8(E) is an explanatory plan view showing a state in which the worm wheel 50 is rotated further from the state shown in FIG. 8(D) to thereby rotate the lock lever 44 further to be located in the locking position. In FIG. 8, only the main parts of the worm wheel 50 and the lock lever 44 are shown with the other elements omitted. However, when the lock lever 44 is shifted from the unlocking position to the locking position, the aforesaid link levers or key levers are operated accordingly in association with the shifting of the lock lever 44, and the door latch device 12 is shifted between the unlocking state and the locking state. In addition, in FIG. 8, to clearly show a relationship between the rotational angle of the first projecting portion 62 and the rotational position of the lock lever 44 which are determined based on the rotation of the worm wheel 50, a mark M1 is given to a distal end of one of the three first tooth portions 62*a* which make up the first projecting portion 62, and a mark M2 is given to another of the three first tooth portions 62*a*.

Firstly, a locking operation will be described in which the lock lever 44 is rotated from the unlocking position to the locking position.

As shown in FIG. 8(A), when the lock lever 44 is in the unlocking position, for example, it means that the lock lever 44 has rotated in the clockwise direction to stop in that position, and the rotational end face 58*a* of the first engagement arm 58 is in abutment with (or close to) the locking surface 68 of the specific first tooth portion 62*a* of the first projecting portion 62 of the worm wheel 50 which stays stationary in the first stop position.

In this state, when a control switch provided inside a passenger compartment or a portable control switch is operated to lock the door D, the motor 48 rotates in the locking direction, whereby the worm wheel 50 rotates in the locking direction (the clockwise direction, that is, a direction indicated by an arrow A1) from the position shown in FIG. 8(A). As shown in FIG. 8(B), when the worm wheel 50 has rotated through 13.87°, for example, the curved surface 66 of the first tooth portion 62*a* which follows the locking surface 68 of the specific first tooth portion 62*a* in the locking direction starts to be brought into abutment with the corner portion of the rotational end face 58*a* of the first engagement arm 58 (an upper portion of an inner surface 58*b* which forms an inner surface of an outer edge of the first engagement arm 58). When the worm wheel 50 rotates further in the locking direction, as shown in FIG. 8(C), the curved surface 66 of the first tooth portion 62*a* presses against the lock lever 44 while in slicing contact with the upper portion of the inner surface 58*b* of the first engagement arm 58, whereby the lock lever 44 rotates in the locking direction (the counterclockwise direction, a direction indicated by an arrow B2). When the worm wheel 50 continues to rotate in the locking direction as shown in FIG. 8(D), the lock lever 44 rotates further largely in the locking direction.

Finally, as shown in FIG. 8(E), when the worm wheel 50 rotates through, for example, 128.46°, the first engagement arm 58 goes out of the rotational locus of the first projecting portion 62, and the lock lever 44 stops in the locking position. Subsequently, the second engagement arm 60 enters the rotational locus of the second projecting portion 64, and the locking surface 72 of the second projecting portion 64 of the worm wheel 50 is brought into abutment with the rotational end face 60*a* of the second engagement arm 60. This stops the rotation of the worm wheel 50, and the worm wheel 50 stops in the second stop position, whereby the shifting operation of the lock lever 44 to the locking position is completed, which puts the door latch device 12 in the locking state.

Next, an unlocking operation will be described in which the lock lever 44 is rotated from the locking position to the unlocking position.

This unlocking operation proceeds in a reverse direction to the locking operation described above. As shown in FIG. 8(E), when the lock lever 44 is in the locking position, it means that the lock lever 44 has rotated in the counterclockwise direction and stops there, and the rotational end face 60*a* of the second engagement arm 60 is in abutment with (or close to) the locking surface 72 of the specific second tooth portion 64*a* of the second projecting portion 64 of the worm wheel 50 which stays stationary in the second stop position.

In this state, when the control switch provided inside the passenger compartment or the portable control switch is operated to unlock the door D, the motor 48 rotates in the unlocking direction, whereby the worm wheel 50 rotates in the unlocking direction (the counterclockwise direction, that is, a direction indicated by an arrow B1) from the position shown in FIG. 8(E). Then, as shown in FIG. 8(D), the curved surface 70 of the second tooth portion 64*a* which follows the locking surface 72 of the specific second tooth portion 64*a* in the unlocking direction starts to be brought into abutment with the corner portion of the rotational end face 60*a* of the second engagement arm 60 (an upper portion of an inner surface 60*b* which forms an inner surface of an outer edge of the second engagement arm 60). When the worm wheel 50 rotates further in the unlocking direction, as shown in FIGS. 8(C) and 8(B), the curved surface 70 of the second tooth portion 64*a* presses the lock lever 44 to rotate it while in sliding contact with the upper portion of the inner surface 60*b* of the second engagement arm 60, and this rotates the lock lever 44 in the unlocking direction (the clockwise direction, that is, a direction indicated by an arrow A2).

Finally, as shown in FIG. 8(A), when the worm wheel 50 rotates, for example, through 128.46° in the reverse direction to the locking operation, the second engagement arm 60 goes out of the rotational locus of the second projecting portion 64, and the lock lever 44 stops in the unlocking position. Subsequently, the first engagement arm 58 enters the rotational locus of the first projecting portion 62, and the locking surface 68 of the first projecting portion 62 of the worm wheel 50 is brought into engagement with the rotational end face 58*a* of the first engagement arm 58. This stops the rotation of the worm wheel 50, and the worm wheel 50 stops in the first stop position, whereby the shifting of the lock lever 44 to the unlocking position is completed, and this puts the door latch device 12 in the unlocking state.

In this way, when the lock lever 44 is shifted from the unlocking position to the locking position or from the locking position to the unlocking position by the rotation of the worm wheel 50, for example, in the actuator unit of PTL 1 described above, the operation angle through which the projecting portions of the worm wheel come into abutment with the engagement arms of the lock lever is large and is set to about 230°, for example. Because of this, it is necessary that the high-output motor is used to reduce the operation time, however, the large impact noise is produced when the projecting portions of the worm wheel are brought into abutment with the rotational end faces of the engagement arms. Then, in order to absorb the impact noise, it is necessary that the impact noise absorbing member is set between the rotational end faces of the engagement arms and the projecting portions of the worm wheel (refer to PTL 3).

In contrast with this conventional actuator unit, in the actuator unit 10 according to this embodiment, as shown in FIG. 7, when the worm wheel 50 is in the first stop position and the second stop position, the locking surface 68 of the first projecting portion 62 and the locking surface 72 of the second projecting portion 64 are situated along the rotational locus of the first engagement arm 58 and the rotational locus of the second engagement arm 60 of the lock lever 44 and are situated on the concentric circles which are centered at the shaft center of the pivot 56 of the lock lever 44.

By adopting this configuration, in the actuator unit 10, in the unlocking position shown in FIG. 7(A) and the locking position shown in FIG. 7(B), the curved surfaces 66, 70 of the first and second tooth portions 62*a*, 64*a* which lie adjacent to the specific first and second tooth portions 62*a*, 64*a* which are in abutment with (or close to) the first engagement arm 58 and the second engagement arm 60 are set in the positions which are spaced the slight gaps t1, t2 away therefrom. In particular, in this embodiment, as shown in FIGS. 7(A) and 7(B), the curved surfaces 66, 70 of the first and second tooth portions 62*a*, 64*a* set so as to intersect extensions of the rotational loci of the first engagement arm 58 and the second engagement arm 60. Thus, the curved surfaces 66, 70 of the first and second tooth portions 62*a*, 64*a* which lie adjacent to the specific ones start to be brought into abutment with the inner surfaces 58*b*, 60*b* of the first and second engagement arms 58, 60 of the lock lever 44 immediately after the worm wheel 50 starts to rotate as shown in FIG. 8(B) when the locking operation is performed and as shown in FIG. 8(D) when the unlocking operation is performed. Moreover, for example, when the locking operation is performed, the first engagement arm 58 is kicked out largely to go out of the rotational locus of the first projecting portion 62 by the curved surface 66 of the first projecting portion 62 as shown in FIG. 8(D). As this occurs, the locking surface 68 of the first projecting portion 62 which follows the curved surface 66 thereof has already been situated almost along the rotational locus of the first engagement arm 58 and the locking surface 72 of the second projecting portion 64 has been close to the rotational end face 60*a* of the second engagement arm 60 on the side of the worm wheel 50 which constitutes a rear side thereof. Thus, the rotational end face 60*a* and the locking surface 72 are brought into abutment with each other without any delay, whereupon the locking operation is completed (refer to FIG. 8(E)). The unlocking operation is performed substantially in a similar way. Consequently, the operation angle of the lock lever 44 from the start of the unlocking operation or the locking operation to the start of the rotation of the lock lever 44 and further to the stop of the rotation of the lock lever 44 can be shortened. Thus, even though a low-output motor is used for the motor 48, the locking operation and the unlocking operation can be performed within desired operation times in an ensured fashion, and impact noise produced when the locking surfaces 68, 72 are brought into abutment with the rotational end faces 58*a*, 60*a* can be reduced.

Additionally, in the actuator unit 10 of this embodiment, for example, when the locking operation is performed, as shown in FIG. 8(B), the lock lever 44 starts to rotate when the worm wheel 50 has rotated through about 13.87° since the start of its rotation and stops rotating when the worm wheel 50 has rotated through about 128.46°, while in the actuator unit of PTL 1 described above, the lock lever starts to rotate when the worm wheel has rotated through about 64° and stops rotating when the worm wheel has rotated through about 230°. Thus, the difference between the operation angles of the two actuator units becomes large.

Further, in the actuator unit 10 of this embodiment, the locking surfaces 68 of the first projecting portion 62 and the locking surfaces 72 of the second projecting portion 64 are situated on the concentric circles which are centered at the shaft center of the pivot 56 of the lock lever 44, whereby although the locking operation and the unlocking operation are ensured within the small operation angles described above, as shown in FIGS. 7(A) and 7(B), in such a state that the lock lever 44 stays in the unlocking position or the locking position while the worm wheel 50 stays stationary in the first stop position or the second stop position, the first and second projecting portions 62, 64 of the worm wheel 50 are not situated on the rotational loci of the first and second engagement arms 58, 60 of the lock lever 44. By adopting this configuration, when the lock knob or the key cylinder which makes up the manual control means is operated manually, the worm wheel 50 is never drawn by the lock lever 44, whereby the lock lever 44 is permitted to rotate between the unlocking position and the locking position smoothly.

In this embodiment, the locking surfaces 68, 72 are described as being situated at least partially on the concentric circles, and this means that the locking surfaces 68, 72 should be formed so that outlines of the locking surfaces 68, 72 follow at least partially the arcs C1, C2, C3, C4 in plan views shown in FIG. 7, and hence, the locking surfaces 68, 72 do not have to be situated on the concentric circles along the full length of their outlines. In other words, in consideration of achieving the smooth rotational operations of the first and second engagement arms 58, 60 during the manual unlocking or locking operation, it is preferable that recess portions are formed at side portions of the locking surfaces 68, 72 for facilitating the escape of the rotational end faces 58*a*, 60*a* when the first and second engagement arms 58, 60 rotate.

It is noted that the invention is not limited to the embodiment that has been described heretofore and can, of course, be modified freely without departing from the spirit and scope of the invention.

For example, in the embodiment, while the first and second projecting portions 62, 64 of the worm wheel 50 are described as each having the three first and second tooth portions 62*a*, 64*a*, the number of first and second tooth portions 62*a*, 64*a* may, of course, be four or more. In short, the locking surfaces 68, 72 of the specific first and second tooth portions 62*a*, 64*a* should be configured so as to be at least partially situated on the concentric circles when the worm wheel 50 stays stationary in the first stop position and the second stop position.

INDUSTRIAL APPLICABILITY

According to the invention, it is possible to provide the actuator unit which can shorten the operation time of the door latch device without calling for the increase in the number of parts involved.

While the invention has been described in detail and by reference to the specific embodiment, it is obvious to those skilled in the art to which the invention pertains that various alterations or modifications can be made thereto without departing from the spirit and scope of the invention. This patent application is based on Japanese Patent Application (No. 2012-086627) filed on Apr. 5, 2012, the contents of which are incorporated herein by reference.

REFERENCE SIGNS LIST

10 Actuator unit
12 Door latch device
44 Lock lever
48 Motor
50 Worm wheel
50*a*, 50*b* Rotational surface
52 Worm
54 Support shaft portion
56 Pivot
58 First engagement arm
58*a*, 60*a* Rotational end face
60 Second engagement arm
62 First projecting portion
62*a* First tooth portion
64 Second projecting portion
64*a* Second tooth portion
68, 72 Locking surface.

The invention claimed is:

1. An actuator unit comprising a drive gear, which is rotatable by a motor, and a lock lever, which is rotatable on a predetermined shaft center, the actuator unit being configured to shift a door latch device between a locking state and an unlocking state by rotating the lock lever between a locking position and an unlocking position either by driving the motor or by operating manual control means provided on a door, wherein the drive gear has a first projecting portion, which is formed on a first rotational surface that is one of rotational surfaces on either side of the drive gear, and a second projecting portion, which is formed on a second rotational surface that is the other rotational surface of the rotational surfaces on either side of the drive gear, wherein the lock lever has a first engagement arm, which is opposed to the first rotational surface of the drive gear so as to be brought into abutment with the first projecting portion, and a second engagement arm, which is opposed to the second rotational surface so as to be brought into abutment with the second projecting portion, wherein the first projecting portion has pressing surfaces, a first one of which is brought into abutment with the first engagement arm in a first rotational direction of the drive gear, and locking surfaces, a first one of which is brought into abutment with a rotational end face of the first engagement arm in a second rotational direction which is opposite to the first rotational direction, the pressing surfaces and the locking surfaces being provided so as to be aligned alternately at intervals along a circumferential direction of the drive gear, wherein the second projecting portion has pressing surfaces, a first one of which is brought into abutment with the second engagement arm in the second rotational direction of the drive gear, and locking surfaces, a first one of which is brought into abutment with a rotational end face of the second engagement arm in the first rotational direction, the pressing surfaces and the locking surfaces of the second projecting portion being provided so as to be aligned alternately at intervals along the circumferential direction of the drive gear, each of the pressing surfaces of the second projecting portion being provided in back-to-back relation to a corresponding one of the locking surfaces of the first projecting portion, and each of the locking surfaces of the second projecting portion being provided in back-to-back relation to a corresponding one of the pressing surfaces of the first projecting portion, wherein in a case where the lock lever is in the locking position, when the drive gear is rotated in the second rotational direction by the motor, the first pressing surface of the second projecting portion is brought into abutment with the second engagement arm, whereby the lock lever rotates to the unlocking position, and subsequently, the first locking surface of the first projecting portion is brought into abutment with the rotational end face of the first engagement arm, whereby the drive gear stops in a first stop position, wherein in a case where the lock lever is in the unlocking position, when the drive gear is rotated in the first rotational direction by the motor, the first pressing surface of the first projecting portion is brought into abutment with the first engagement arm, whereby the lock lever rotates to the locking position, and subsequently, the first locking surface of the second projecting portion is brought into abutment with the rotational end face of the second engagement arm, whereby the drive gear stops in a second stop position, wherein in a case where the drive gear is in the first stop position, the first locking surface of the first projecting portion which is in abutment with the rotational end face of the first engagement arm is situated along an arc-shaped first rotational locus of the rotational end face of the first engagement arm, and the first locking surface of the second projecting portion, which is provided in back-to-back relation to the first pressing surface of the first projecting portion which follows the locking surface thereof in the first rotational direction, is situated along an arc-shaped second rotational locus of the rotational end face of the second engagement arm which is concentric with the first rotational locus, and wherein in a case where the drive gear is in the second stop position, the first locking surface of the second projecting portion which is in abutment with the rotational end face of the second engagement arm is situated along the second rotational locus, and the first locking surface of the first projecting portion, which is provided in back-to-back relation to the first pressing surface of the second projecting portion which follows the first locking surface of the second projecting portion in the second rotational direction, is situated along the first rotational locus.

2. The actuator unit according to claim 1, wherein in the case where the drive gear is in the first stop position, the first pressing surface of the first projecting portion, which follows in the first rotational direction the first locking surface of the first projecting portion which is in abutment with the rotational end face of the first engagement arm, intersects an extension of the first rotational locus, and wherein in the case where the drive gear is in the second stop position, the first pressing surface of the second projecting portion, which follows in the second rotational direction the first locking surface of the second projecting portion which is in abutment with the rotational end face of the second engagement arm, intersects an extension of the second rotational locus.

3. The actuator unit according to claim 1, wherein the first projecting portion has three first tooth portions which are disposed at equal angular intervals along the circumferential direction of the drive gear, and each of the pressing surfaces is provided on an end face of each of the first tooth portions so as to be oriented towards the first rotational direction, while each of the locking surfaces is provided on an end face of each of the first tooth portions so as to be oriented towards the second rotational direction, and wherein the second projecting portion has three second tooth portions which are disposed at equal angular intervals along the circumferential direction of the drive gear, and each of the pressing surfaces is provided on an end face of each of the second tooth portions so as to be oriented towards the second rotational direction, while each of the locking surfaces is provided on an end face of each of the second tooth portions so as to be is oriented towards the first rotational direction.

4. The actuator unit according to claim 1, wherein the first projecting portion and the second projecting portion are disposed back-to-back into a symmetrical configuration on either side of the drive gear.

5. A door latch device, characterized by comprising the actuator unit according to claim 1.

* * * * *